United States Patent [19]

Mauer

[11] Patent Number: 4,896,909

[45] Date of Patent: Jan. 30, 1990

[54] OPENER

[75] Inventor: Güenter Mauer, Heiligenhaus, Fed. Rep. of Germany

[73] Assignee: Mauer GmbH, Heiligenhaus, Fed. Rep. of Germany

[21] Appl. No.: 153,966

[22] Filed: Feb. 9, 1988

[30] Foreign Application Priority Data

Feb. 9, 1987 [DE] Fed. Rep. of Germany ..... 3703909

[51] Int. Cl.[4] ..... E05B 15/02

[52] U.S. Cl. ..... 292/341.16; 292/201

[58] Field of Search ..... 292/341.16, 341.15, 292/341.17, 207, 201, 251.5

[56] References Cited

U.S. PATENT DOCUMENTS

| | | | |
|---|---|---|---|
| Re. 30,263 | 4/1980 | Horvath | 292/341.16 |
| 1,638,240 | 8/1927 | Caron | 292/341.16 |
| 2,325,225 | 7/1943 | Burke | 292/201 X |
| 3,640,560 | 2/1972 | Zawadzki et al. | 292/201 X |
| 3,910,617 | 10/1975 | Scalza et al. | 292/341.16 |
| 4,211,443 | 7/1980 | Butts et al. | 292/341.16 |
| 4,471,983 | 9/1984 | Bischoff et al. | 292/341.16 |
| 4,573,333 | 3/1986 | Choi | 292/201 X |
| 4,616,865 | 10/1986 | Mackle | 292/341.16 |
| 4,626,010 | 12/1986 | Hanchett, Jr. et al. | 292/341.16 |

FOREIGN PATENT DOCUMENTS

| | | | |
|---|---|---|---|
| 78629 | 10/1919 | Austria | 292/207 |
| 49215 | 11/1888 | Fed. Rep. of Germany | 292/341.16 |
| 1138334 | 10/1962 | Fed. Rep. of Germany | 292/201 |

*Primary Examiner*—Gary L. Smith
*Assistant Examiner*—Michael J. Milano
*Attorney, Agent, or Firm*—Ralf H. Siegemund

[57] ABSTRACT

A door opener includes a pivotably mounted locking plate, and an electromagnet, a tangentially effective wedge element is mounted to the locking plate, an axially adjustable and movable drive slide of the shaped cross section is operatively connected to the wedge; a control slide is resiliently mounted in the drive slide; a blocking pin is mounted on the control slide; and an armature is pivotably mounted on the control slide to hold or release ultimately the locking plate.

5 Claims, 2 Drawing Sheets

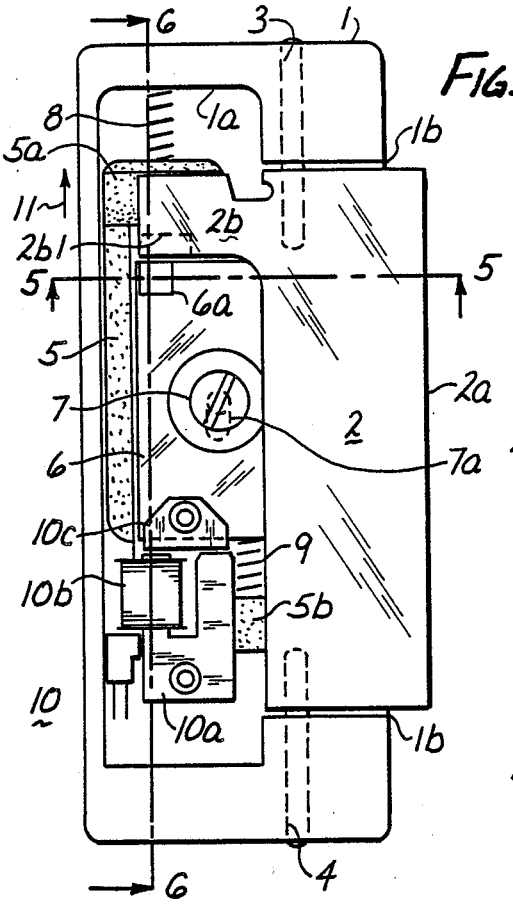
FIG. 1
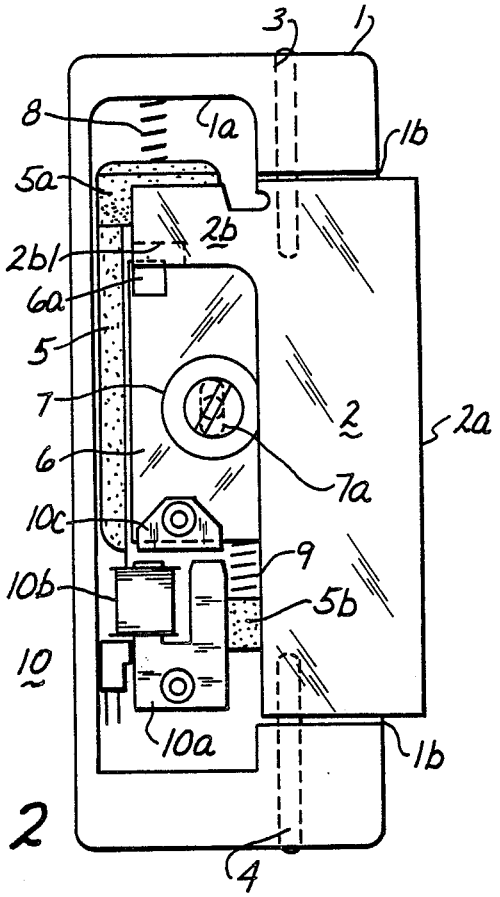
FIG. 2
FIG. 6
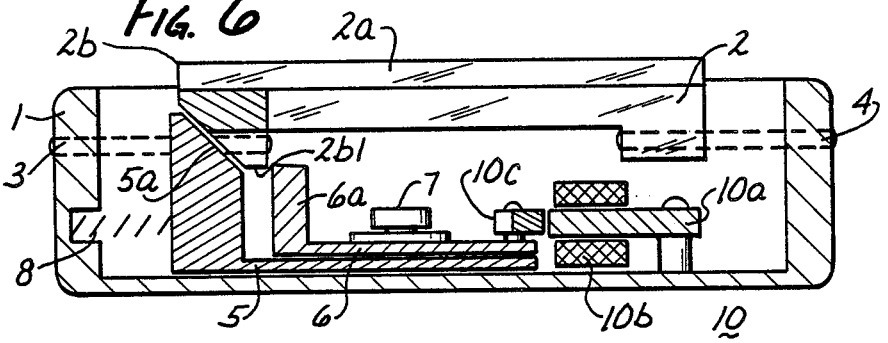

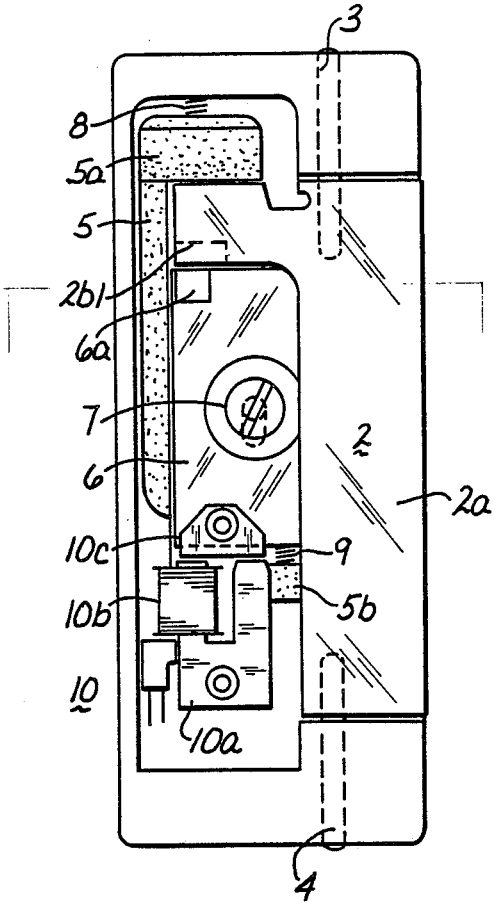
FIG. 3
FIG. 4
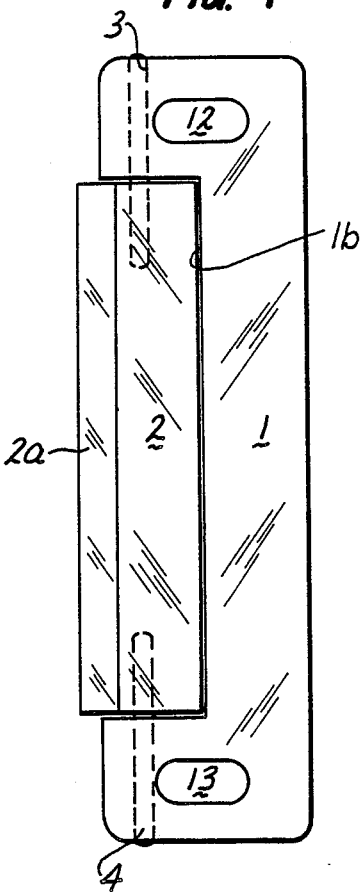
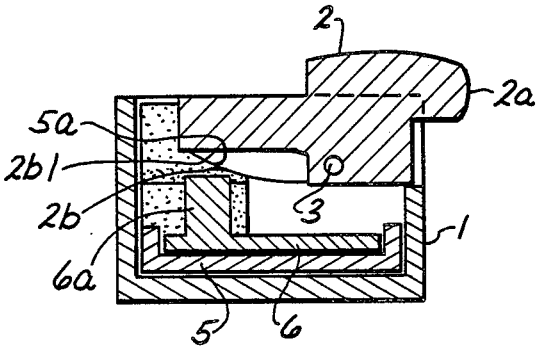
FIG. 5

OPENER

BACKGROUND OF THE INVENTION

The present invention relates to an electromagnetically controlled door or gate opener for pivotable gates, doors, covers or the like pertaining to and covering, closing etc., boxlike casings, housings or the like.

Known electromagnetic door and gate openers include a closing sheet or locking plate having a cam for driving a one arm lever. The end of this lever rests on a blade of a control lever which in turn carries an elongated electromagnetic armature. The armature is maintained in a position of rest through the force of a spring and in that position the closing sheet or locking plate is locked or blocked. The electromagnet itself, moreover, is comprised of a U-shaped yoke with two rather strong coils. These coils will be energized with alternating current of low voltage and cause the yoke to attract the spring loaded armature whereby certain amount of lifting work is exerted and provided so that the aforementioned blade releases the lever as well as the locking plate. Since the magnetic force is effective across a rather larger air gap for purposes of moving the armature one needs a rather large operating current.

DESCRIPTION OF THE INVENTION

It is an object of the present invention to improve equipment of the type mentioned above particularly for purposes of reducing the magnetic volume and power consumption of such gate or door openers to a significant extent while the manufacture is to be simplified as well as rendered more economical.

In accordance with the preferred embodiment of the present invention, it is suggested to provide a tangentially effective wedge and to connect the same with the locking plate such that the wedge acts on an axially movable and displaceable drive slide; the slide acts as a drive whereby a control slide is resiliently positioned on the drive slide while the control slide carries a locking pin as well as an armature which faces and is part of an electromagnet whose yoke parts are stationarily mounted within a housing, casing or the like and/or adjacent to the gate or door which is is to be closed and opened by advancing and retracting the locking plate.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 shows a gate structure in accordance with the preferred embodiment of the present invention for practicing the best mode thereof; the gate being shown in a closing position;

FIG. 2 is a view similar to FIG. 1 illustrating an attempt of opening but without a release pulse being present;

FIG. 3 shows the equipment of FIGS. 1 and 2 but now in an open state;

FIG. 4 illustrates the gate structure in a side view;

FIG. 5 is a section taken along lines A and B in FIG. 1; and

FIG. 6 is a section taken along line C-D in FIG. 1.

Proceeding to the detailed description of the drawings, FIG. 1 shows a boxlike casing or housing 1 being provided with a troughlike indent or recess 1*a*. A second but shallower trough or recess 1*b* is provided for mounting a gate element or locking sheet or plate 2 which has a right hand edge 2*a* which extends beyond the edge of the housing 1 and holds the not illustrated trap of a gate or door.

For purposes of mounting plate 2 two cylindrical pins 3 and 4 are provided which are inserted in suitable bores of the housing 1 and extend towards each other. The closing sheet or locking plate 2 is provided as shown in the drawings in the upper left hand corner of FIG. 1. The projection is configured as a drive wedge 2*b*. Wedge 2*b* acts on a complementary surface 5*a* of a drive slide 5. The wedge shaped surface portion 5*a* is shown in FIG. 5.

A control slide 6 is mounted on the slide 5. The slide 6 is provided with a locking pin 6*a*. Both slides are movable in longitudinal direction (relative to each other) and for this they are provided with oblong slots. The oblong slot 7*a* shown in FIG. 1 pertains to the slide 6. A corresponding oblong slot is provided in the slide 5 being somewhat longer than the slot 7*a* but registering with the slot 7*a* in vertical alignment that is transversed to the plane of the drawing of FIG. 1. Both slots are penetrated by a threaded bolt 7. A spring 8 is provided between slide 5 and housing 1. Another coil spring 9 is provided between an edge shape portion 5*b* of the slide 5 and the control slide 6. An electromagnet 10 is provided with a stationary yoke 10*a*, a coil 10*b* and an armature 10*c*. The armature 10*c* is pivotably mounted on the slide 6 while the yoke 10*a* and the coil 10*b* are mounted on housing 1.

The door opener as described operates as follows. Assuming the electromagnet 10*a*, *b* is not energized electrically i.e. no current flows through the coil 10*b* and the plate 2 is pivoted counterclockwise, wedge 2*b* shifts wedge 5*a*. Consequently the slide 5 is shifted in direction of the arrow 11. Slide 6 is caused to follow the movement of slide 5 through the projection 5*b* and the spring 9 simply because the armature 10*c* can recede from the yoke 10*a*. The blocking pin 6*a* moves under the wedge 2*b* until a particular locking surface 2*b*1 abuts the pin 6*a*; now plate 2 is blocked following the particular advance that is necessary for obtaining the described control operation. This particular operational state is shown in FIG. 2.

On the other hand if as per FIG. 3 an electrical energizing pulse is applied to the electromagnet 10*a*,*b* the armature 10*c* is now held against the yoke 10*a* so that the slide 6 with its blocking pin 6*a* remains at rest. Hence in this situation of movement of plate 2, the surface 2*b*1 passes pin 6*a* and the slide 5 will be moved to the uppermost position. Now the locking plate 2 is pivoted to such an extent that its edge 2*a* will no longer project and the gate can be opened. As soon as no external force is exerted any more upon the opener the spring 8 forces the slide 5 as well as the plate 2 back into the initial position.

The spring 9 is assumed to have a very small retraction force only. It it merely required that the spring 9 moves the slide 6 whenever the magnet 10 is not energized. On the other hand, whenever the magnet is energized the spring must be capable of allowing for the entire displacement path of the slide 5. The springs 8 and 9 are specifically mounted in bores in the parts 1 and 2 (not shown). It is important in principle that there are long springs and long spring paths involved.

FIG. 4 illustrates oblong slots 12 and 13 into which nuts can be inserted through lateral openings in the housing. The opener is fastened to a door cover by means of two screws and can be adjusted to accommodate particulars of the gate or door.

The cross section shown in FIG. 5 illustrates generally the trough shape of the housing 1. Moreover, one can readily see the U shape of the drive slide 5 and the more complex configurations of the control slide 6, being mounted on the drive slide 5. One can see the rear side of the drive wedge 2*b* whose wedge surface abuts the inclined surface 5*a* of the slide 5. A particular spacing remains between the blocking surface 2*b*1 and the blocking pin 6*a* whenever the parts are at rest. This spacing, in reality, is about 2–3 mm. The spacing permits a certain advance between the plate 2 and the slides 5 and 6 prior to obtaining the blocking effect.

FIG. 6 illustrates a longitudinal section through the opener as shown in FIG. 1 and particularly the rest or normal state is shown. As mentioned earlier the cylinder pins 3 and 4 pivotably mount the cover 2 onto the housing 1. The slide 5 is situated with its wedged surface 5*a* directly under the drive wedge 2*b*, the wedge 2*b* of course pertains to the cover 2. The control slide 6 as stated is slidably mounted on the drive slide 5. The locking pin 6*a* is initially outside of the track of the locking surface 2*b*1. The screw 7 prevents that the two slides 5 and 6 separate from each other; for this oblong slots are provided including slot 7*a*.

Spring 8 maintains the slide 5 in the resting position shown in FIG. 6. Whenever the electromagnet 10 is not energized by electric current, and the cover 2 is forced down. Thereafter the wedge surface 2*b* is shifted over the wedge surface 5*a* to thereby cause the slide 5 to be moved to the left in FIG. 6. The armature 10*c* mounted on slide 6 is not stopped, blocked or otherwise impeded. Thus the spring 9 will force the slide 6 also to the left. The spring 9 is not visible in FIG. 6 but is shown in FIG. 1. The locking pin 6*a* will then move under the surface 2*b*1 and block the cover 2 after a short path has been traversed. On the other hand as the electromagnet is energized the armature 10*c* is held and that in turn means that the slide 6 is being held. Consequently wedge 2*b* of cover 2 can shift the slide 5 all the way to the left. In this case cover 2 is deflected to the maximum extent possible which in turn means that the rim or edge 2*a* recedes sufficiently far so that the gate or door can be opened.

The door opener as described has the advantage that the magnet 10 will provide no lifting work. The yoke 10*a* merely is required to hold the armature 10*c*. The holding action occurs in an optimum position of the armature relative to the yoke 10*a*. The holding force is a small one and single small coil with low energizing power suffices for that purpose. One can readily see that this magnet can easily be powered from batteries providing but a few volts dc. In order to demonstrate the preparedness for opening an illuminating and/or blinking diode may be included so as to provide an optical signal of the operational state. Battery operated door openers and gate openers are particularly of advantage in certain access systems wherein an opening control pulse is furnished from a decoding device. The decoding device may e.g. read the code on magnetic strip of a card that has been inserted, or keyed-in code or the like. The release coil and the electronics can all be powered for a long period of time from a single battery which does not require replacement throughout that period. This means that the installation costs are quite small. Basically the particular device can be provided either in the door frame or elsewhere in other parts of the door.

The invention is not limited to the embodiments described above but all changes and modifications thereof, not constituting departures from the spirit and scope of the invention, are intended to be included.

I claim:

1. Door opener including a pivotably mounted locking plate, further including electromagnetic means including an yoke and an armature, comprising:

a tangentially effective wedge element mounted to the locking plate;

an axially adjustable and movable drive slide operatively connected to said wedge element;

a control slide resiliently mounted on said drive slide;

a blocking pin mounted on the control slide; and said armature being pivotally mounted on said control slide.

2. Opener as in claim 1, said drive slide being provided with a wedge element engaging the wedge surface of said plate, a blocking surface adjacent to the wedge element of the plate passing said blocking pin whenever the control slide is held by the electromagnet.

3. Opener as in claim 2, there being a spacing between said blocking surface of the plate and said pin, in the unenergized state of the magnet.

4. Opener as in claim 3, said spacing being between 1 and 3 mm.

5. Opener as in claim 2, said drive slide having essentially a U-shaped cross section defining a recess, said control slide being mounted in said recess, said housing having a recess, the drive slide being mounted for sliding in the recess of the housing.

* * * * *